US005774986A

United States Patent [19]

Nishimura et al.

[11] Patent Number: 5,774,986

[45] Date of Patent: Jul. 7, 1998

[54] METHOD AND APPARATUS FOR COLD-FORMING OF TOOTHED WHEELS FROM SHEET METAL

[75] Inventors: Fumitaka Nishimura, Yokohama; Hideyasu Akiyoshi, Kameoka; Shigeo Murata, Kobe, all of Japan

[73] Assignee: Nissan Motor Co., Ltd., Yokohama, Japan

[21] Appl. No.: 710,770

[22] Filed: Sep. 20, 1996

[30] Foreign Application Priority Data

Sep. 22, 1995 [JP] Japan ..... 7-269419

[51] Int. Cl.[6] ..... B21D 53/28; B21D 15/00

[52] U.S. Cl. ..... 29/893.32; 29/893.36; 72/110

[58] Field of Search ..... 29/893.32, 893.36, 29/892.3; 72/68, 102, 107–110

[56] References Cited

U.S. PATENT DOCUMENTS

| | | | |
|---|---|---|---|
| 3,631,704 | 1/1972 | Leonard et al. | 29/893.32 |
| 3,745,851 | 7/1973 | Zeldman et al. | 29/893.32 |
| 3,894,418 | 7/1975 | Hörl | 29/893.32 |
| 4,708,912 | 11/1987 | Huppmann | 29/893.32 |
| 4,796,345 | 1/1989 | Krapfenbauer | 29/159.2 |
| 4,945,783 | 8/1990 | Grob | 74/460 |
| 5,152,061 | 10/1992 | Himmeroeder | 29/893.32 |
| 5,203,223 | 4/1993 | Himmeroeder | 74/449 |
| 5,237,744 | 8/1993 | Himmeroeder | 29/893.32 |
| 5,237,745 | 8/1993 | Yamanaka | 72/68 |
| 5,396,787 | 3/1995 | Kanemitsu et al. | 29/893.32 |
| 5,404,640 | 4/1995 | Himmeroeder | 29/893.32 |
| 5,562,785 | 10/1996 | Yamanaka | 29/893.32 |

FOREIGN PATENT DOCUMENTS

| | | |
|---|---|---|
| 4-37432 | 2/1992 | Japan . |
| 6-63670 | 3/1994 | Japan . |
| 7-47439 | 2/1995 | Japan . |
| 7-503902 | 4/1995 | Japan . |

*Primary Examiner*—P. W. Echols
*Attorney, Agent, or Firm*—Foley & Lardner

[57] ABSTRACT

A toothed wheel is cold formed from a circular piece or plate of sheet metal by cold-forming an annular outer section of the sheet metal into a preform, while the sheet metal is held in a rotary holding unit and rotated about its preform axis. While the sheet metal is rotating, a thickening roller works against the sheet metal's an outer annular section to thicken the same and form a wheel having a generally uniform cross-sectional outer annular section and an integral central wall that extends radially inwardly from the outer annular section. The outer annular section is formed by a multi-stage cold rolling process, utilizing different thickening rollers. Then, while the preform is rotating, a curling roller works on the outer annular section to form an axially extending flange, forming a cylindrical or C-shaped wheel to form a final preform. Then, while the final preform is rotating, a tooth forming roller is meshed against the outer periphery of the flange. At the same time, a back-up roller engages the flange at a different location to further shape the flange.

12 Claims, 6 Drawing Sheets

METHOD AND APPARATUS FOR COLD-FORMING OF TOOTHED WHEELS FROM SHEET METAL

BACKGROUND OF THE INVENTION

1. Field of the Invention

The present invention relates to toothed wheels of the type utilized in motor vehicles and more particularly to improvements in the method of making such toothed wheels.

2. Description of Prior Art

Toothed wheels, as herein utilized, include toothed timing belt pulleys, starter gears and the like.

It has long been known that substantial manufacturing cost and weight savings could be achieved if a satisfactory gear could be fabricated from a single piece of sheet metal by forming the sheet metal into the final configuration using cold-forming techniques. Indeed, the patented literature contains proposals for making motor vehicle gears. For example, JP-A 7-47439 published on Feb. 21, 1995 discloses a method of making an externally toothed wheel, including forming a preform from a circular piece of sheet metal by cold-forming a lip on the outer periphery of a circular blank by rolling over a circular peripheral edge of the circular blank with a curling roller. The lip has a uniform thickness, which is substantially the same as that of the circular blank and curled to define a radially inwardly opening C-shaped channel. Thereafter, a tooth forming roller is rolled over the outer surface of the C-shaped channel of the circular blank. During this rolling process, the C-shaped channel is clamped between parallel guide walls of the tooth forming roller and cold-formed into a flange having at an exterior surface thereof a series of teeth.

A problem with this manner of formation is that it transforms a recessed wall of the C-shaped channel into an interior surface of the flange, resulting in reduction in wall thickness in the central portion of the flange. It follows that the reduction comes in the central portion of the resultant teeth. Thus, in order to provide adequate strength to this central portion, a starting piece of sheet metal of greater thickness must be chosen, which materially increases both weight and costs.

Another cost factor in practicing the method of the JP-A 7-47439 is that the tooth forming roller with the guide walls requires increased time and skill to fabricate. Besides, the frequency of replacing the roller with a new one necessarily increases owing to a short service life resulting mainly from its complicated structure.

An object of the present invention is to provide a method of making toothed wheels from sheet metal which method provides increased concentration of the amount of metal of an annular section of a circular piece of sheet metal into a series of teeth and the back-up for the teeth.

Another object of the present invention is to provide an apparatus for conducting the method.

SUMMARY OF THE INVENTION

In accordance with the method of the preferred embodiment, a circular piece of sheet metal is cold-formed by multi-stage cold-rolling utilizing a plurality of different thickening rollers into a preform having an outer annular section or outer peripheral edge with thickened solid configuration. This thickened annulur section is cold-formed into a series of teeth by a teeth forming roller.

According to one aspect of the present invention, there is provided a method of forming a toothed wheel including a series of cold-formed peripheral teeth, comprising the steps of:

cold-forming a circular piece of sheet metal of a predetermined thickness into a preform having an outer annular section of generally uniform cross-sectional configuration and an integral central wall generally of said predetermined thickness extending radially inwardly from said outer annular section toward a preform axis utilizing a plurality of different thickening rollers; and rotating said preform about said preform axis relative to a tooth forming roller with an outer periphery of said outer annular section in meshing action with said tooth forming roller.

Specifically, there is provided according to the present invention a method of forming a toothed wheel including a series of cold-formed peripheral teeth utilizing a rotary holding unit having structure providing radially outwardly facing control surface means, and a tooth forming tool holding unit carrying a tooth forming roller, said method comprising the steps of:

cold-forming a circular piece of sheet metal of a predetermined thickness into a preform having an outer annular section of generally uniform cross-sectional configuration and an integral central wall generally of said predetermined thickness extending radially inwardly from said outer annular section toward a preform axis by contacting the outer annular section with a first stage thickening roller and the control surface means and thereafter contacting the outer annular section with a second stage thickening roller and the control surface means; and rotating the rotary holding unit with said preform secured thereto -about said preform axis relative to the tooth forming roller with an outer periphery of said outer annular section in meshing action with said tooth forming roller.

According to the more specific aspect of the present invention, there is provided a method of forming a toothed wheel including a series of cold-formed peripheral teeth utilizing a rotary holding unit having structure providing radially outwardly facing control surface means, a turret holding a first stage thickening roller having a groove angle, a second stage thickening roller having a groove angle greater than the groove angle of the first stage thickening roller, a curling roller, and a back-up roller having two parallel flanges formed with tooth side forming surfaces, respectively, and a tooth forming tool holding unit holding a tooth forming roller, said method comprising the steps of:

cold-forming a circular piece of sheet metal of a predetermined thickness into a preform having an outer annular section of generally uniform cross-sectional configuration and an integral central wall generally of said predetermined thickness extending radially inwardly from said outer annular section toward a preform axis by cold-rolling the outer annular section by the first stage thickening roller into a first stage thickened solid configuration in contact with the first stage thickening roller and the control surface means, by cold-rolling the outer annular section with the first stage thickened configuration by the second stage thickening roller into a second stage thickened solid configuration contact with the second stage thickening roller and the control surface means, and by cold-rolling the outer annular section with the second stage thickened configuration by the curling roller into a final solid configuration in the form of a flange extending from the periphery of the central wall; and rotating the rotary holding unit with said preform secured thereto about said preform axis relative to the tooth forming tool holding unit with an outer periphery of said outer annular section in meshing action with the tooth forming roller on one hand and in engagement with the back-up roller on the other hand.

According to another aspect of the present invention, there is provided an apparatus for forming a toothed wheel including a series of cold-formed peripheral teeth, comprising a rotary holding unit having structure providing radially outwardly facing control surface means, said rotary holding unit having secured thereto a preform having an outer annular section of generally uniform cross-sectional configuration and an integral central wall generally of said predetermined thickness extending radially inwardly from said outer annular section toward a preform axis;

a turret holding a first stage thickening roller having a groove angle, a second stage thickening roller having a groove angle greater than the groove angle of the first stage thickening roller, a curling roller, and a back-up roller having two parallel flanges formed with tooth side forming surfaces, respectively; and a tooth forming tool holding unit holding a tooth forming roller, the back-up roller being movable into opposed relation with the tooth forming roller for engagement with the outer annular section while the outer annular section is in meshing action with the tooth forming roller.

DETAILED DESCRIPTION OF THE INVENTION

Figure 1:
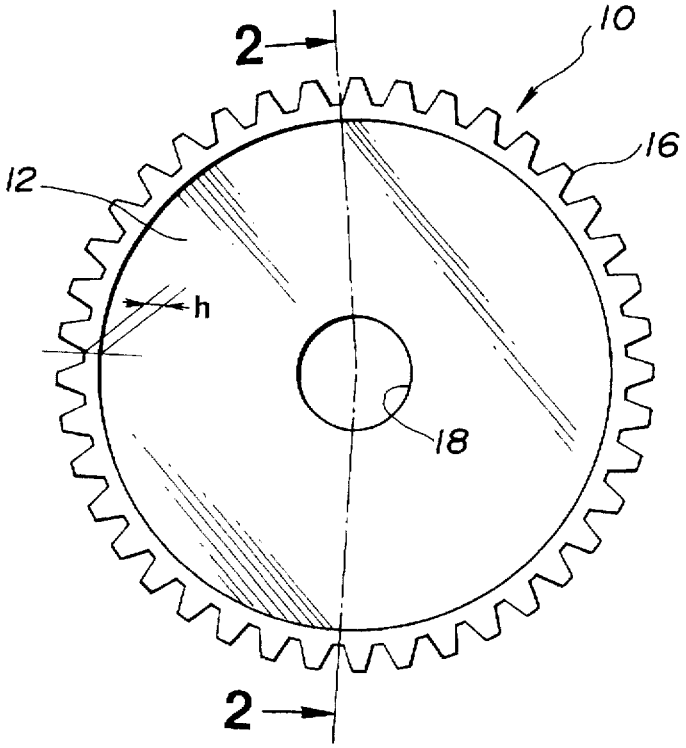
FIG. 1 is a front view of an externally toothed gear viewing along an arrow 1 in FIG. 2 constructed in accordance with the method of the present invention.
Figure 2:
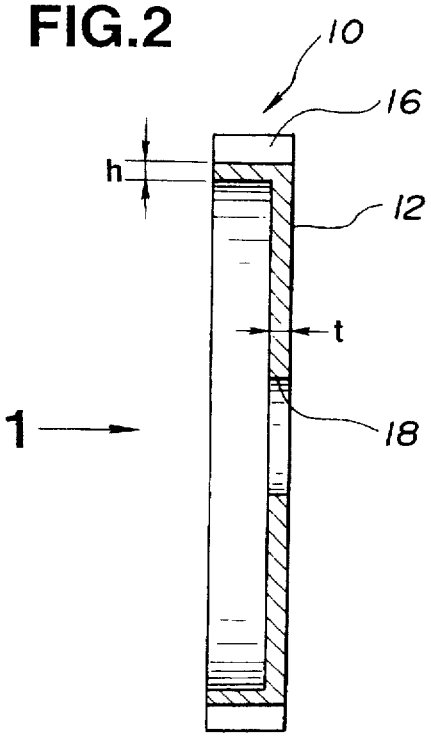
FIG. 2 is a section taken through the line 2—2 in FIG. 1.
Figure 3:
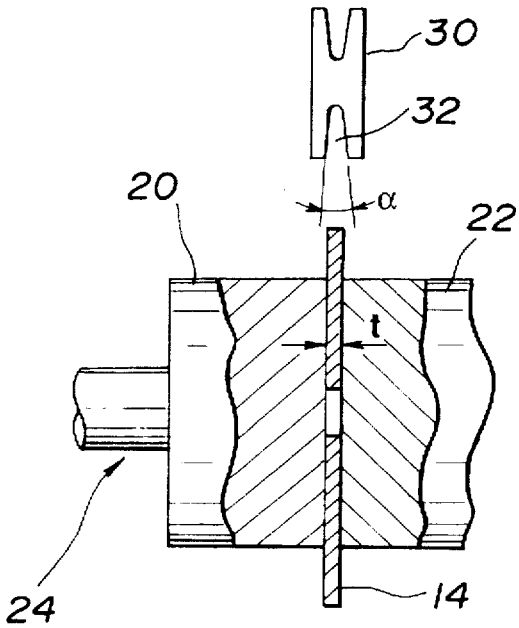
FIG. 3 is a sectional view of a circular piece of sheet metal which constitutes the starting material in practicing the principle of the present invention together with a first thickening roller.

Referring now more particularly to FIGS. 1 to 8, there is shown a toothed wheel generally designated at 10 constructed in accordance with the principle of the present invention. FIGS. 3A, 4A, 5A and 7 illustrate various steps in the method of making the toothed wheel 10 in accordance with one embodiment of the present invention. As shown, the toothed wheel 10 is made from a single circular piece of sheet metal, as, for example, steel capable of being cold-formed. As best shown in FIGS. 1 and 2, the toothed wheel 10 includes a central wall 12 of sheet metal having a thickness t equal to the predetermined thickness of the sheet metal, which is the starting material. The thickness t ranges from 2 mm to 3 mm. FIG. 3 illustrates in cross section a circular piece of sheet metal 14 the formation of which constitutes a first step in the method of making the toothed wheels from the sheet metal.

The toothed wheel 10 also includes an annular section formed integrally with the outer periphery of the central wall 12. The annular section is cold-formed into a series of gear teeth 16. As shown, the central wall 12 is formed with a central opening 18.

Figure 8:
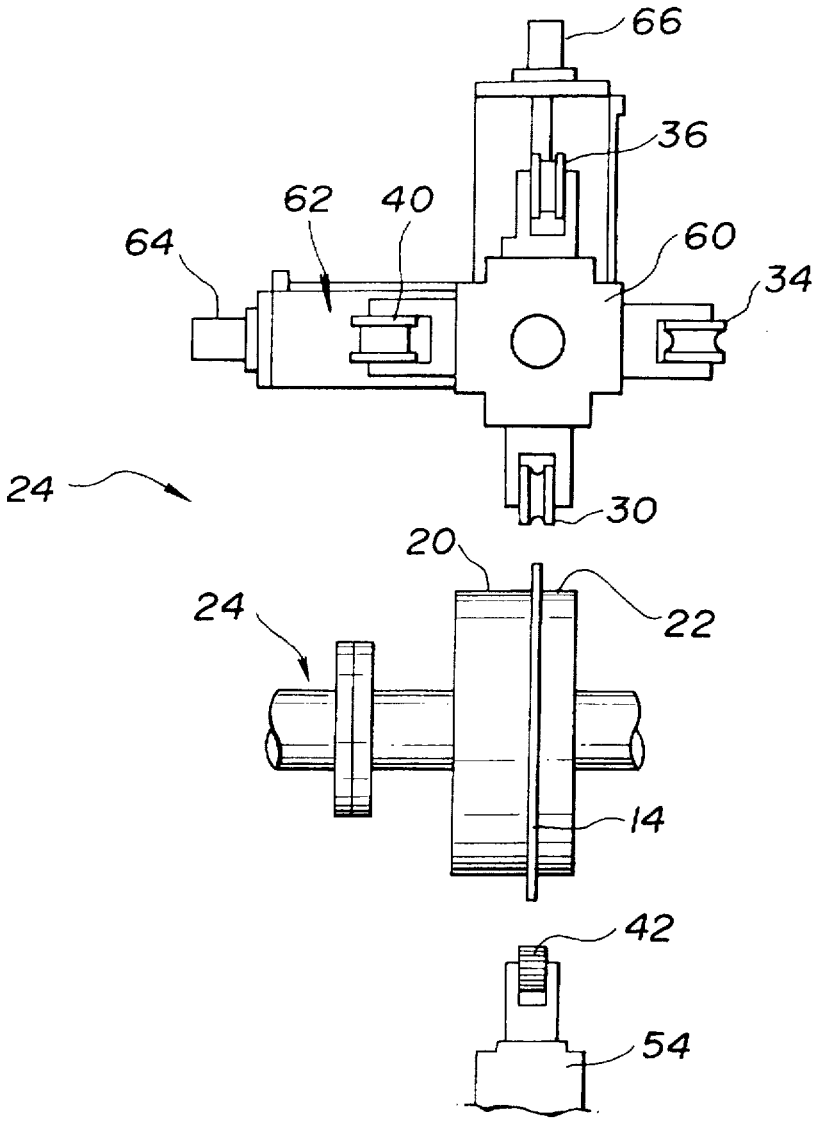
FIG. 8 is a diagrammatic view illustrating the entire rotary holding unit and rotary tooth forming tool unit shown in FIG. 7.

Referring now more particularly to FIG. 3, the circular piece of sheet metal 14 is a separate piece, which may be stamped from a continuous sheet of metal. The circular piece of sheet metal 14 is securely held between a rotary holding member 20 and a complementary rotary holding member 22 of a rotary holding unit 24 of a spinning machine 26, which is illustrated in FIG. 8. A first stage rotary thickening roller 30, rotatable about an axis parallel to the axis of rotation of the rotary holding unit 24, has at a rim thereof a groove 32 with a groove angle of alpha. This groove angle alpha is determined after due consideration of the thickness t of the sheet metal and ranges from 5 to 6 degrees.

Figure 3A:
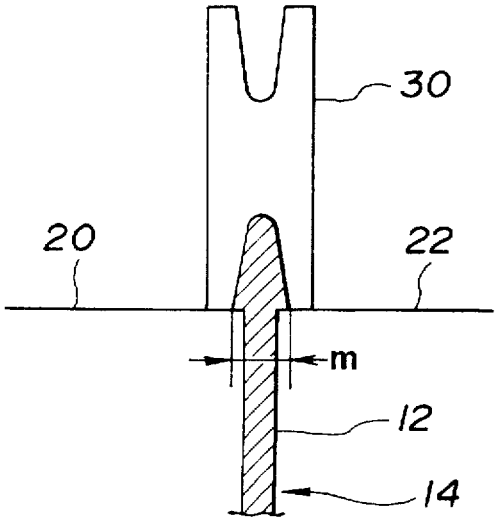
FIG. 3A is a fragmentary sectional view of FIG. 3 illustrating a first step in the method of the present invention, where a first preform is cold-formed by thickening an annular section or a circular peripheral edge of the circular piece.

Referring to FIGS. 3 and 3A, the circular piece of sheet metal 14 thus secured between the rotary holding members 20 and 22 is cold-formed into a first stage thickened preform by moving the rotary thickening roller 30 radially inwardly with respect to the axis of rotation of the rotary holding unit 24 into engagement with the outer periphery of the annular section integral with the central wall 12, while the rotary holding unit 24 is rotated about the axis of rotation to thus cold-form the outer periphery of the annular section radially inwardly into a configuration where the adjacent portion of the periphery of the central wall 12 is thickened. The thickened adjacent portion has a thickness m substantially greater than the thickness t of the central wall 12. More specifically, the thickness m is two or three times as much as the thickness t of the sheet metal.

Preferrably, the volume of the annular section is such that, at the completion of this first stage cold-forming, sheet metal will be cold-formed into contact with cylindrical control surfaces of the rotary holding members 20 and 22 extending from the outer periphery of the central wall 12. Moreover, the walls of the groove 32 are preferrably brought into contact substantially with the entire sides extending from the outer periphery or crest of the annular section.

Figure 4:
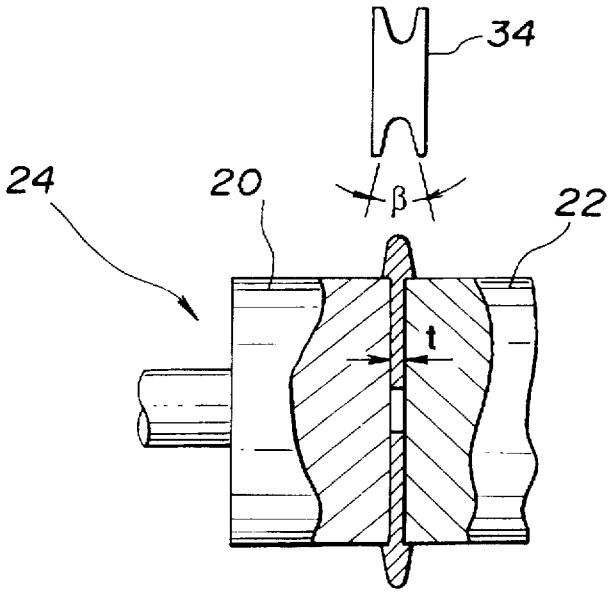
FIG. 4 is a view similar to FIG. 3 showing the first preform with a second thickening roller.
Figure 4A:
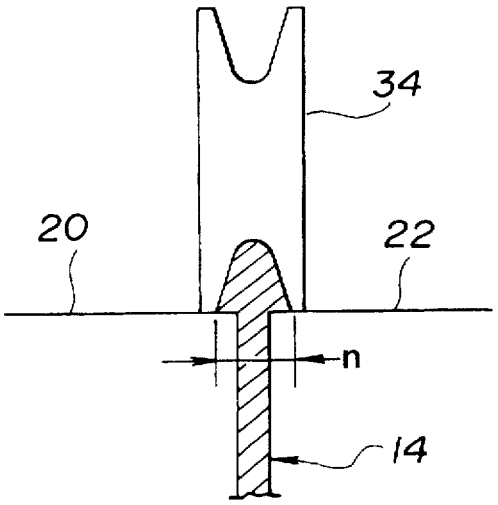
FIG. 4A is a view similar to FIG. 3A showing the next or second step in the method of the present invention, where a second preform is cold-formed by further thickening the thickened circular peripheral edge of the first preform.

Referring to FIGS. 4 and 4A, the first stage thickened preform is then cold-formed into a further or second stage thickened preform by moving another or second stage rotary thickening roller 34, having a groove angle beta B greater than alpha a (see FIG. 4,) radially inwardly into engagement with the outer periphery of the first stage thickened annular section integral with the central wall 12, while the rotary holding unit 24 of the spinning machine 26 is rotated to thus cold-form the outer periphery of the annular section radially inwardly into a configuration where the adjacent portion of the periphery of the central wall 12 is further thickened. Preferrably, the groove angle B ranges from 35 to 27 degrees. The further thickened adjacent portion has a thickness n greater than the thickness m (see FIG. 3A).

Preferrably, the relation of the groove of the second stage thickening roller 34 with the volume of the annular section is such that, at the completion of this second stage cold-forming, sheet metal extending from the outer periphery of the central wall 12 will be cold-formed into contact with the cylindrical control surfaces of the rotary holding members 20 and 22. Moreover, the walls of the groove of the thickening roller 34 are preferrably brought into contact substantially with the entire sides extending from the outer periphery or crest of the annular section.

Figure 5:
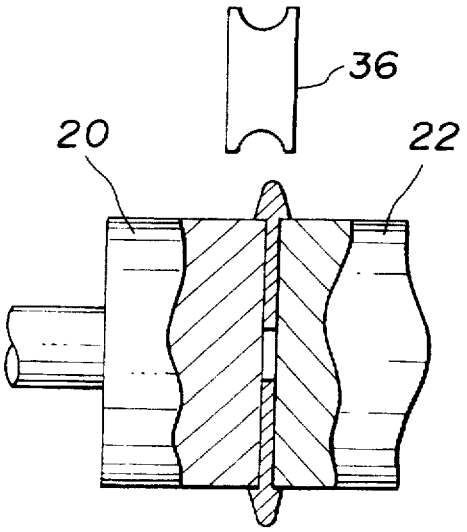
FIG. 5 is a view similar to FIG. 3 showing the second preform with a third or curling roller.
Figure 5A:
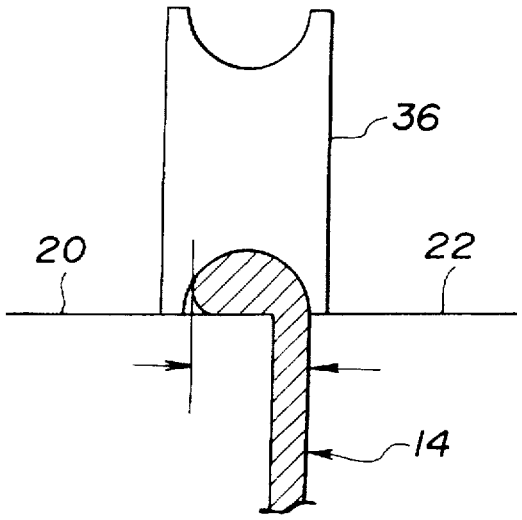
FIG. 5A is a view similar to FIG. 4A showing the next or third step in the method of the present invention, where a final preform is cold-formed into a can by curling the thickened circular peripheral edge into a flange.

Referring to FIGS. 5 and 5A, the further or second stage thickened preform secured between the rotary holding members 20 and 22 is cold-formed into a final preform by moving a rotary curling roller 36. This roller is moved radially inwardly with respect to the axis of rotation of the rotary holding unit 24 into engagement with the outer periphery of the further thickened annular section integral with the central wall 12, while the rotary holding unit 24 of the spinning machine 26 is rotated about the axis of rotation to thus cold-form the thickened annular section into a flange 38 extending axially from the outer periphery of the central wall 12.

Preferrably, the relation of the groove of the curling roller 36 with the volume of the annular section is such that, at the completion of this cold-forming, sheet metal will be cold-formed into contact with the cylindrical control surface of the rotary holding member 20 extending from the outer periphery of the central wall 12. Moreover, the walls of the groove of the curling roller 36 are preferrably brought into contact substantially with the entire sides extending from the outer periphery of the annular section.

Figure 6:
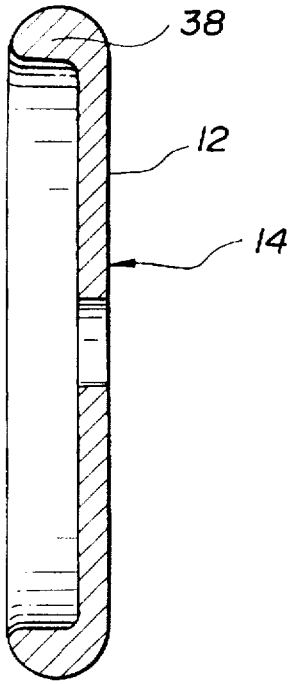
FIG. 6 is a sectional view of the final preform.

As shown in FIGS. 5A and 6, the axial flange 38 bulges radially outwardly to define a rounded exterior surface. The flange 38 extends complementary with the cylindrical control surface of the rotary holding member 20 to define a cylindrical planar interior surface.

Figure 7:
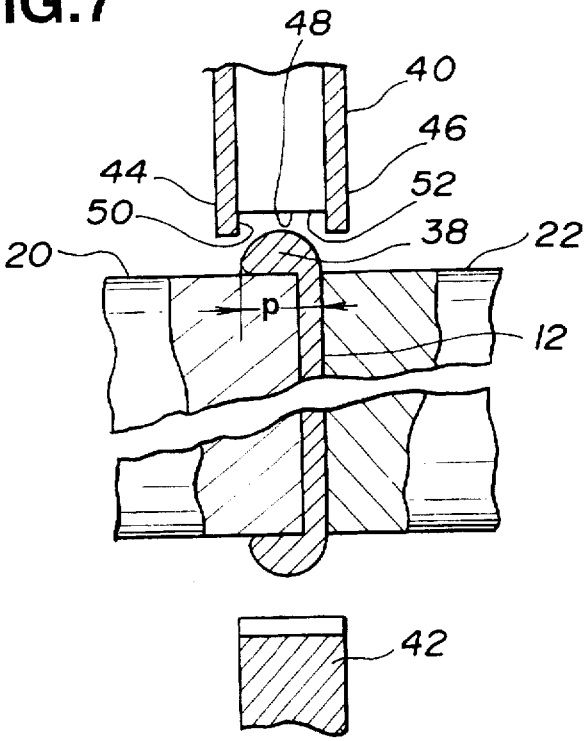
FIG. 7 is a view similar to FIG. 5 showing the teeth forming step in the method of the present invention, where the thickened flange of the final preform is cold-formed into a series of teeth.

Referring to FIG. 7, the next cold-forming step is to cold-form the series of teeth 16 in the bulged-out exterior surface of the flange 38 of the final preform. The cold-forming of the series of teeth 16 is accomplished by a rotary back-up roller 40 and a rotary tooth forming roller, both arranged around the rotary holding unit 24. The rotary back-up roller 40 is opposed to the rotary tooth forming roller 42 and has two annular flanges 44 and 46, which extend beyond a cylindrical wall 48. It will be noted that the flanges 44 and 46 include oppositely facing tooth-side forming surfaces 50 and 52, respectively, which are of smooth planar configuration disposed radially, with respect to the axis of rotation of the rotary holding unit 24 when the back-up roller 40 is brought radially inwardly into engagement with the annular section of the circular piece of sheet metal 14, and parallel with one another spaced apart a predetermined distance, which is greater than the thickness t of the central wall 12. The tooth forming roller 42 is mounted in a tooth forming tool holding unit 54 (see FIG. 8).

It will be noted that the axial length p of the flange 38 of the final preform is greater than the predetermined thickness t of the sheet metal but slightly less than the predetermined distance between the tooth side forming surfaces 50 and 52 of the flanges 50 and 52 of the back-up roller 40.

The tooth forming roller 42 is moved into meshing relation with the bulged-out exterior surface of the annular section in the form of the flange 38 of the final preform secured in the spinning machine 24, while the rotary back-up roller 40 is moved into contact with the annular section at a position angularly displaced, with respect to the axis of rotation of the rotary holding unit 24, from the tooth forming roller 42 through 180 degrees. This positional relationship between the tooth forming roller 42 and the back-up roller 40 can suppress bending of the flange 38 owing to the stress imparted thereto by the tooth forming roller 42 during the cold-forming of the series of teeth 16.

As the tooth forming roller 42 of the tooth forming tool holding unit 54 moves to the flange 38 of the final preform in cooperating metal deforming relation inwardly of the bulged-out exterior periphery thereof, the flange 38 is cold-formed into the series of teeth 16. During this movement, the peripheries of the series of teeth 16 are cold-formed by rolling contact with the tooth forming tool structure of the tooth forming roller 42 and portions of the sides of the series of teeth 16 are limited by contact with the tooth-side forming surfaces 50 and 52 of the flanges 44 and 46 of the back-up roller 40 so that an amount of metal that would otherwise uncontrollably flow axially outwardly of the tooth-side forming surfaces is concentrated within the teeth and/or the radially inward back-up therefor. In this regard, it will be noted that the radially inward movement of the flange 38 is controlled by the cylindrical control surface of the rotary holding member 20 during the cold-forming of the series of teeth 16. In the preferred embodiment, the cylindrical control surface of the rotary holding member 20 initially contacts the interior of the flange 38 during the cold-forming of the flange 38 by the curling roller 36 so that, during the cold-forming of the series of teeth 16, the contact is made by a pressure contact and preferrably full control surface contact of the flange 38 occurs as it is moved radially inward during the cold-forming of the series of teeth 16.

Preferably the volume of the flange 34 is such that, at the completion of the cold-forming of the series of teeth 16, the sheet metal will be cold-formed into contact with the entire control surface of the rotary holding member 20 extending from the outer periphery of the central wall 12.

The thickness or difference t between the inner diameter of the series of teeth 16 and the inner diameter of the annular section is uniform over the entire circumference. This is because an amount of sheet metal of the annular section flows radially inwardly into full contact with the cylindrical control surfaces of the rotary holding members 20 and 22 during the first and second stage cold-forming and during cold-forming by the curling roller 36.

If need arises to make a toothed wheel having a central wall within a wheel formed with teeth, the cold-forming by the curling roller is eliminated and the second stage thickened annular section is cold-formed into the series of teeth by the tooth forming roller 42 in cooperation with the back-up roller 40.

The final configuration is given a heat treatment. Preferrably, the heat treatment is by induction heating followed by quenching in liquid to room temperature. Heat treatment is considered desirable in the case where the severe loads are expected to be imposed along the involute surfaces of the teeth in operation.

FIG. 8 illustrates the entire spinning machine 26 and the tooth forming tool holding unit 54. As shown, the spinning machine 26 includes the rotary holding unit 24 and a turret 60 on a 2-axis turret holding unit 62 provided with a motor 64 for advancing the turret 60 in a direction parallel to the axis of rotation of the rotary holding unit 24 and a motor 66 for advancing the turret 60 in a radial direction with respect to the axis of rotation of the rotary holding unit 24. The turret 60 carries the first stage thickening roller 30, the second stage thickening roller 34, the curling roller 36 and the back-up roller 40. The tooth forming roller 42 is carried by the tooth forming tool holding unit 54. The tooth forming tool holding unit 54 is arranged on the opposite side of the rotary holding unit 24, to where the turret holding unit 62 is disposed. When the back-up roller 40 is brought into engagement with the outer periphery of the annular section of the circular piece of sheet metal 14 securely held in the rotary holding unit 24, the tooth forming tool holding unit 54 brings the tooth forming roller 42 into angagement with the outer periphery of the annular section of the circular piece of sheet metal 16. The tool holding unit is angularly displaced by 180° with respect to the axis of rotation of the rotary holding unit 24, from that portion at which the back-up roller 40 engages the circular piece of sheet metal 16. This positional relationship is intended to oppose a reaction force to a force imparted to the circular piece of sheet metal 14 by the tooth forming roller 42, thus minimizing undersired stress on the annular section of the circular piece of sheet metal 14 during the cold-forming into the series of teeth.

According to the method of the preferred embodiment, owing to multi-stage gradual cold-forming by different thickening rollers 30 and 34, the annular section of the circular piece of sheet metal 14 is thickened to a satisfactorily high level although the sheet metal is thin. This ensures further thickening of the annular section during the step of curling by the curling roller 36 and concentration of metal radially inward of teeth during the subsequent teeth forming step.

According to the apparatus of the preferred embodiment, the turret 60 of the spinning machine 26 enables continuous operation of cold-forming by the first stage thickening roller 30, cold-forming by the second stage thickening roller 34, and cold-forming by the curling roller 36, and the back-up roller 40 and the tooth forming roller 42 are brought into opposed relation across the annular section of the circular piece of sheet metal 14 during teeth forming operation.

It will be realized that the foregoing preferred specific embodiment has been shown and described for the purpose of this invention and is subject to change without departure from the principles of the invention. Therefore, the present invention includes all modifications encompassed within the spirit and scope of the following claims.

What is claimed is:

1. A method of forming a toothed wheel having a series of cold-formed peripheral teeth from a circular piece of sheet metal of a predetermined thickness, comprising the steps of:

cold-forming an outer annular periphery of said circular piece into a preform having a flange of generally uniform cross-sectional configuration having a thickness greater than said predetermined thickness and an integral central wall generally of said predetermined thickness extending radially inwardly from said flange toward an axis of the circular piece by, while rotating said circular piece about the circular piece axis with a rotary holding unit:

contacting said outer annular periphery with a plurality of different thickening rollers to form an outer annular section, and cold-rolling said outer annular section with a curling roller to form said flange, which extends axially from the periphery of said central wall; and while rotating said preform about said circular piece axis with said rotary holding unit, meshing a tooth forming roller against said flange to form said plurality of teeth.

2. A method as set forth in claim 1, wherein said plurality of different rollers comprise first and second stage thickening rollers, said preform being formed by cold-rolling the outer annular periphery into a first stage thickened solid configuration with said first stage thickening roller, followed by cold-rolling said first stage thickened solid configuration into a second stage thickened solid configuration having a thickness greater than a thickness of said first stage thickened solid configuration with said second stage thickening roller.

3. A method as set forth in claim 2, wherein said first and second stage thickening rollers each have a groove angle, the groove angle of the first stage thickening roller being less than the groove angle of the second stage thickening roller.

4. A method as set forth in claim 1, further comprising the step of engaging the flange with a back-up roller, which is in opposed relationship with the tooth forming roller during meshing action of the flange with the tooth forming roller.

5. A method as set forth in claim 4, wherein the back-up roller has two parallel flanges formed with tooth side forming surfaces.

6. A method of forming a toothed wheel having a series of cold-formed peripheral teeth from a circular piece of sheet metal of a predetermined thickness, comprising the steps of:

cold-forming an outer annular periphery of said circular piece into a preform having a flange of generally uniform cross-sectional configuration having a thickness greater than said predetermined thickness and an integral central wall generally of said predetermined thickness extending radially inwardly from said flange toward an axis of the circular piece, by, while rotating said circular piece thereof with a rotary holding unit about the axis thereof:

cold-rolling said outer annular periphery with a first stage thickening roller into a first stage thickened solid configuration, cold-rolling said first stage thickened solid configuration with a second stage thickening roller into a second stage thickened solid configuration having a thickness greater than that of said first stage thickened solid configuration, and cold-rolling said second stage thickened solid configuration with a curling roller to form said flange, which extend axially from the periphery of said central wall; and while rotating said preform about said circular piece axis with said rotary holding unit, meshing a tooth forming roller against said flange to form said plurality of teeth.

7. A method as set forth in claim 6, wherein the first and second stage thickening rollers each have a groove angle, the groove angle of the first stage thickening roller being less than the groove angle of the second stage thickening roller.

8. A method of forming a toothed wheel having a series of cold-formed peripheral teeth from a circular piece of sheet metal of a predetermined thickness, utilizing a rotary holding unit having a structure providing radially outwardly facing control surface means, a turret holding a first stage thickening roller having a groove angle, a second stage thickening roller having a groove angle greater than the groove angle of the first stage thickening roller, a curling roller, and a back-up roller having two parallel flanges formed with tooth side forming surfaces, and a tooth forming tool holding unit holding a tooth forming roller, said method comprising the steps of:

cold-forming an outer annular periphery of said circular piece, into a preform having a flange of generally uniform cross-sectional configuration having a thickness greater than said predetermined thickness and an integral central wall generally of said predetermined thickness extending radially inwardly from said flange toward an axis of said circular piece, by, while rotating said circular piece with said rotary holding unit about the circular piece axis:

cold-rolling the outer annular periphery with the first stage thickening roller and the control surface means into a first stage thickened solid configuration, cold-rolling the first stage thickened solid configuration with the second stage thickening roller and the control surface means into a second stage thickened solid configuration, and cold-rolling the second stage thickened solid configuration with the curling roller into a final solid configuration in the form of a flange extending axially from the periphery of the central wall; and while rotating said preform about said circular piece axis with said rotary holding unit, meshing the tooth forming roller against the flange and engaging the back-up roller against the flange.

9. A method as set forth in claim 8, wherein at least a portion of the outer annular periphery contacts the control surface means during cold-forming of the preform.

10. A method as set forth in claim 8, wherein the back-up roller engaging the flange is opposingly positioned against the tooth forming roller while the tooth forming roller meshes against the flange.

11. An apparatus for forming a toothed wheel having a series of cold-formed peripheral teeth, comprising:

a rotary holding unit having a structure providing radially outwardly facing control surface means, said rotary holding unit being adapted to secure a preform having an outer annular section of generally uniform cross-sectional configuration and an integral central wall generally of said predetermined thickness extending radially inwardly from said outer annular section toward a preform axis;

a turret holding a first stage thickening roller having a groove angle, a second stage thickening roller having a groove angle greater than the groove angle of the first stage thickening roller, a curling roller, and a back-up roller having two parallel flanges formed with tooth side forming surfaces, respectively; and a tooth forming tool holding unit holding a tooth forming roller, wherein the back-up roller is movable into opposed relation with the tooth forming roller for engagement with the outer annular section while the outer annular section is in meshing action with the tooth forming roller.

12. An apparatus as set forth in claim 11, wherein the outer annular section extends radially outwardly of the control surface means.

* * * * *